US011274813B2

(12) United States Patent
Li et al.

(10) Patent No.: US 11,274,813 B2
(45) Date of Patent: Mar. 15, 2022

(54) LIGHT SOURCE SWITCHING MODULE, LIGHT SOURCE ASSEMBLY AND LIGHTING LAMP

(71) Applicants: OPPLE LIGHTING CO., LTD., Shanghai (CN); SUZHOU OPPLE LIGHTING CO., LTD., Suzhou (CN)

(72) Inventors: Shuangzeng Li, Shanghai (CN); Jing Yang, Shanghai (CN); Shitao Deng, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 17/137,668

(22) Filed: Dec. 30, 2020

(65) Prior Publication Data

US 2021/0116107 A1 Apr. 22, 2021

Related U.S. Application Data

(63) Continuation of application No. PCT/CN2019/124751, filed on Dec. 12, 2019.

(30) Foreign Application Priority Data

Dec. 13, 2018 (CN) ..... 201811528542.0
Dec. 13, 2018 (CN) ..... 201822099887.0

(51) Int. Cl.
*F21V 21/088* (2006.01)
*F21V 23/00* (2015.01)
(Continued)

(52) U.S. Cl.
CPC ..... *F21V 21/088* (2013.01); *F21V 23/003* (2013.01); *F21V 23/04* (2013.01); *F21V 23/06* (2013.01)

(58) Field of Classification Search
CPC ..... F21V 21/088; F21V 23/003; F21V 23/04; F21V 23/06
(Continued)

(56) References Cited

U.S. PATENT DOCUMENTS 4,611,264 A * 9/1986 Bradley ..... F21L 4/085 362/183
6,010,228 A * 1/2000 Blackman ..... F21S 9/022 362/20
(Continued)

FOREIGN PATENT DOCUMENTS

CN 105202494 A 12/2015
CN 205938571 U 2/2017
(Continued)

OTHER PUBLICATIONS

International Search Report of PCT Application No. PCT/CN2019/124751 dated Mar. 13, 2020 with English translation, (4p).

*Primary Examiner* — Bryon T Gyllstrom
(74) *Attorney, Agent, or Firm* — Arch & Lake LLP

(57) ABSTRACT

The present disclosure provides a light source switching module, a light source assembly and a lighting lamp. The light source switching module includes: a switching portion, being provided with an installation portion for installing a light source module; a mechanical connection portion, being fixed on the switching portion and being mechanically connected with a base; and an electrical connection portion, being electrically connected with a power supply connection terminal in the base and being electrically connected with the light source module.

20 Claims, 10 Drawing Sheets

(51) Int. Cl.
*F21V 23/04* (2006.01)
*F21V 23/06* (2006.01)

(58) Field of Classification Search
USPC ..... 362/396
See application file for complete search history.

(56) References Cited

U.S. PATENT DOCUMENTS

| | | | | |
|---|---|---|---|---|
| 6,864,798 | B2 * | 3/2005 | Janik | H04B 3/54 340/693.11 |
| 7,581,844 | B1 * | 9/2009 | Yang | F21L 4/00 362/191 |
| 2006/0104064 | A1 * | 5/2006 | Sharrah | F21V 21/34 362/287 |
| 2007/0153494 | A1 * | 7/2007 | Huang | F21S 9/022 362/20 |
| 2008/0239714 | A1 * | 10/2008 | Boettcher | G09F 13/04 362/183 |
| 2009/0185359 | A1 * | 7/2009 | Martinez | F21L 4/08 362/20 |
| 2012/0268919 | A1 * | 10/2012 | Yang | F21L 4/08 362/95 |
| 2018/0017241 | A1 * | 1/2018 | Grider | G02B 6/0096 |

FOREIGN PATENT DOCUMENTS

| | | | |
|---|---|---|---|
| CN | 206478544 | U | 9/2017 |
| CN | 207621772 | U | 7/2018 |
| CN | 109506217 | A | 3/2019 |
| CN | 209084685 | U | 7/2019 |
| KR | 20050100527 | A | 10/2005 |

* cited by examiner

LIGHT SOURCE SWITCHING MODULE, LIGHT SOURCE ASSEMBLY AND LIGHTING LAMP

CROSS-REFERENCE TO RELATED APPLICATIONS

This application is based upon and claims the priority of PCT patent application No. PCT/CN2019/124751 filed on Dec. 12, 2019 which claims priority to the Chinese patent application No. 201811528542.0 filed on Dec. 13, 2018 and the Chinese patent application No. 201822099887.0 filed on Dec. 13, 2018, the entire content of all of which is hereby incorporated by reference herein for all purposes.

TECHNICAL FIELD

The present disclosure relates to the technical field of illumination, in particular to a light source switching module, a light source assembly and a lighting lamp.

BACKGROUND

Some wall lamps are integral in structure. When a light source of a wall lamp is damaged, it is necessary to detach a base of the wall lamp from the wall for maintenance, so that the maintenance of the light source is laborious and inconvenient.

SUMMARY

The present disclosure provides a light source switching module, a light source assembly and a lighting lamp.

According to a first aspect, the present disclosure provides a light source switching module that is applicable for installing a light source module on a base. The light source switching module may include: a switching portion provided with an installation portion for installing the light source module; a mechanical connection portion fixed on the switching portion and mechanically connected with the base; and an electrical connection portion electrically connected with a power supply connection terminal in the base and electrically connected with the light source module.

According to a second aspect, the present disclosure provides a light source assembly. The light source assembly may include a base, a driving power supply fixed in the base, a power supply connection terminal fixed in the base and connected with the driving power supply, and a light source switching module fixed on the base.

The light source switching module may include: a switching portion provided with an installation portion for installing the light source module; a mechanical connection portion fixed on the switching portion and mechanically connected with the base; and an electrical connection portion electrically connected with a power supply connection terminal in the base and electrically connected with the light source module.

The switching portion may be located on the base, the mechanical connection portion may be mechanically connected with the base, and the electrical connection portion may be electrically connected with the power supply connection terminal.

According to a third aspect, the present disclosure provides a lighting lamp. The lighting lamp may include a base provided with a power supply connection terminal, a light source switching module connected with the base, a light source module arranged on the light source switching module, and a lamp body connected with the base.

The light source switching module may include a switching portion provided with an installation portion for installing the light source module; a mechanical connection portion fixed on the switching portion and mechanically connected with the base; and an electrical connection portion electrically connected with a power supply connection terminal in the base and electrically connected with the light source module.

It is to be understood that both the foregoing general description and the following detailed description are exemplary and explanatory only and are not restrictive of the present disclosure.

BRIEF DESCRIPTION OF THE DRAWINGS

The drawings illustrated herein are used to provide a further understanding of the present disclosure and form a part of the present disclosure. The examples of the present disclosure and the description thereof are used to interpret the present disclosure, and do not constitute improper limitation of the present disclosure.

DETAILED DESCRIPTION

Figure 1:
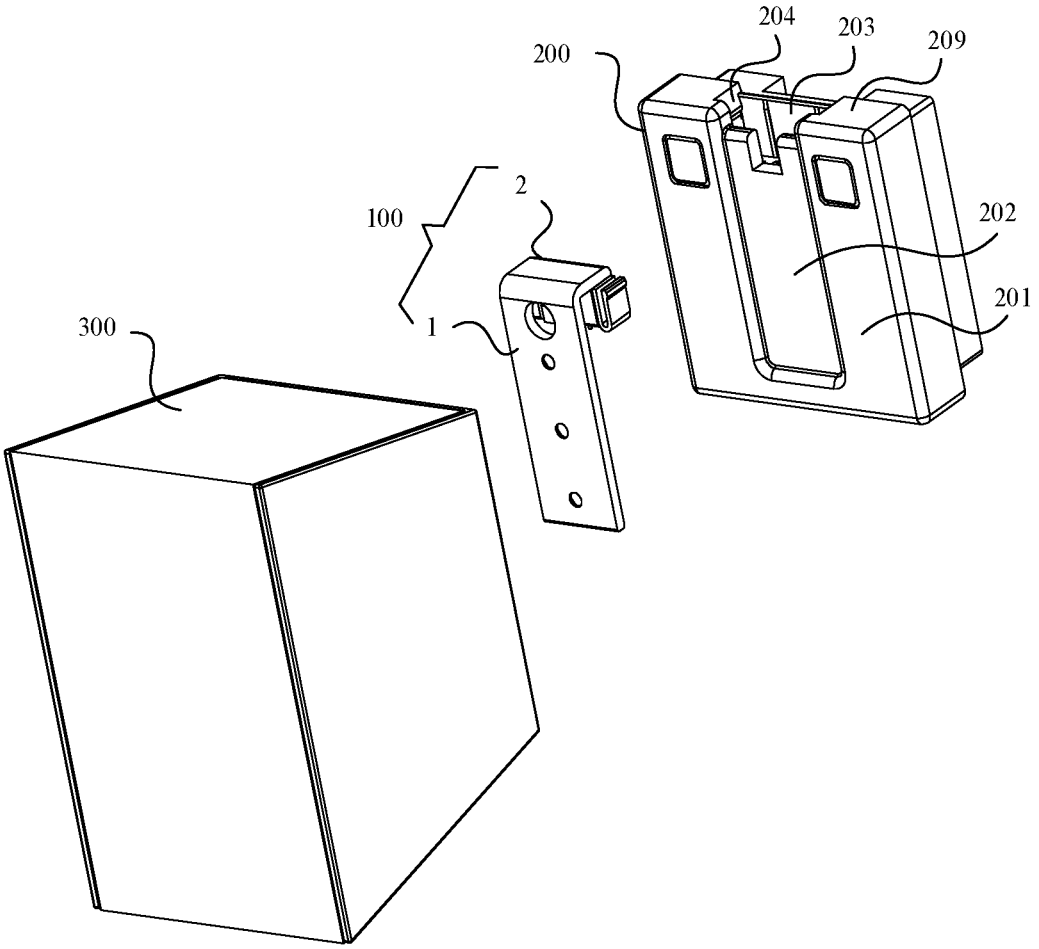
FIG. 1 is a schematic diagram of an exploded structure of a lighting lamp provided in at least one example of the present disclosure.

The detailed description is hereinafter given to the technical solutions of the present disclosure with reference to examples and accompanying drawings. The described examples are only a part of the examples of the present disclosure, not all of the examples. Based on the examples of the present disclosure, all the other examples obtained by those of ordinary skill without any creative works are within the protection scope of the present disclosure.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Description of reference numerals used in this disclosure may include:

light source switching module—100, 100'; base—200, 200'; lamp body—300; light source module—400; switching portion—1, 1'; mechanical connection portion—2, 2'; electrical connection portion—3, 3'; first surface—11, 11'; second surface—12, 12'; installation portions—13, 13'; through hole—14, 14'; bending portion—21, 21'; clamping body—22, 22'; first guide portions—23'; circuit board—31; conductive terminal—32; front wall—201, 201'; installation groove—202; socket—203, 203'; socket wall—204, 204'; power supply connection terminal—205, 205'; connection terminal receiving portion—206'; second guide portion—207'; side wall—208, 208'; top wall—209, 209'; bottom wall—210, 210'; clamping groove—211; clamping plate—221; and elastic clamping portion—222.

Figure 2:
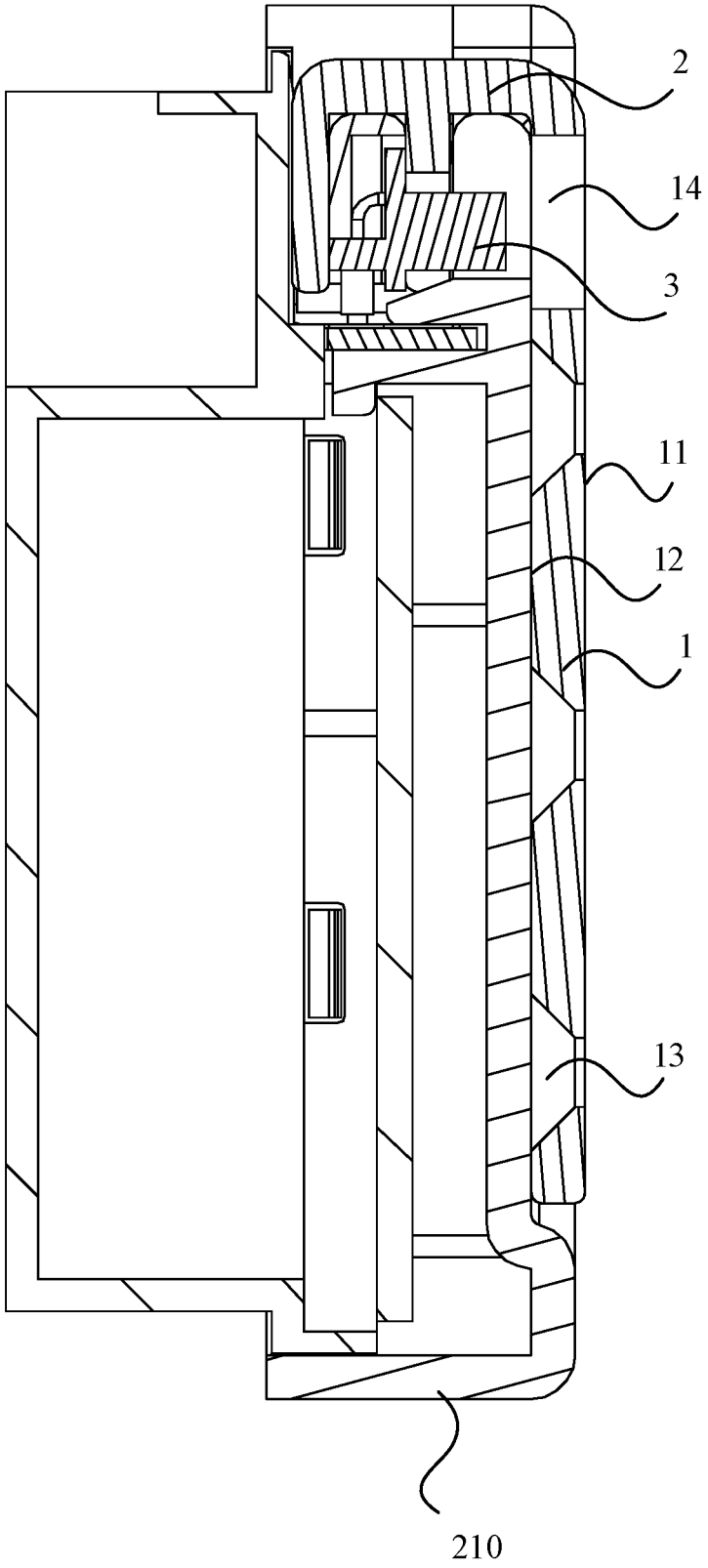
FIG. 2 is a cross-sectional diagram of a light source switching module perpendicular to a top wall of a base after being installed on the base, provided in at least one example of the present disclosure.
Figure 3:
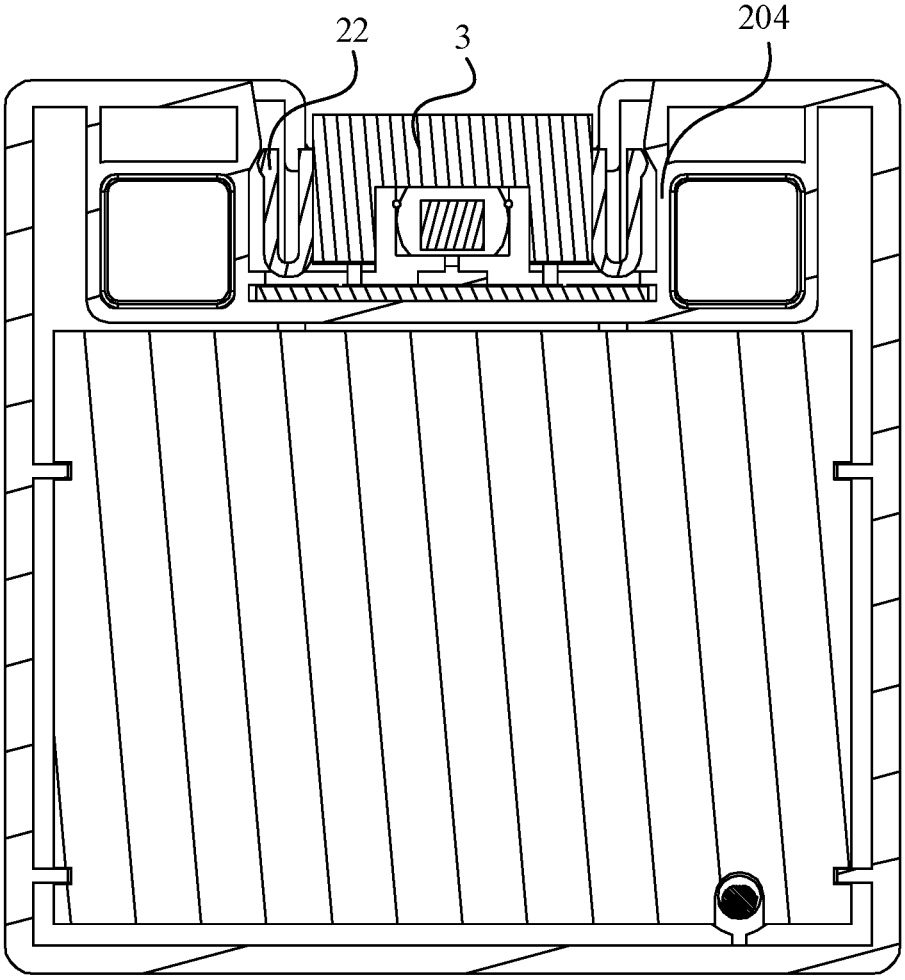
FIG. 3 is a cross-sectional diagram of the light source switching module parallel to the top wall of the base after being installed on the base, provided in at least one example of the present disclosure.
Figure 4:
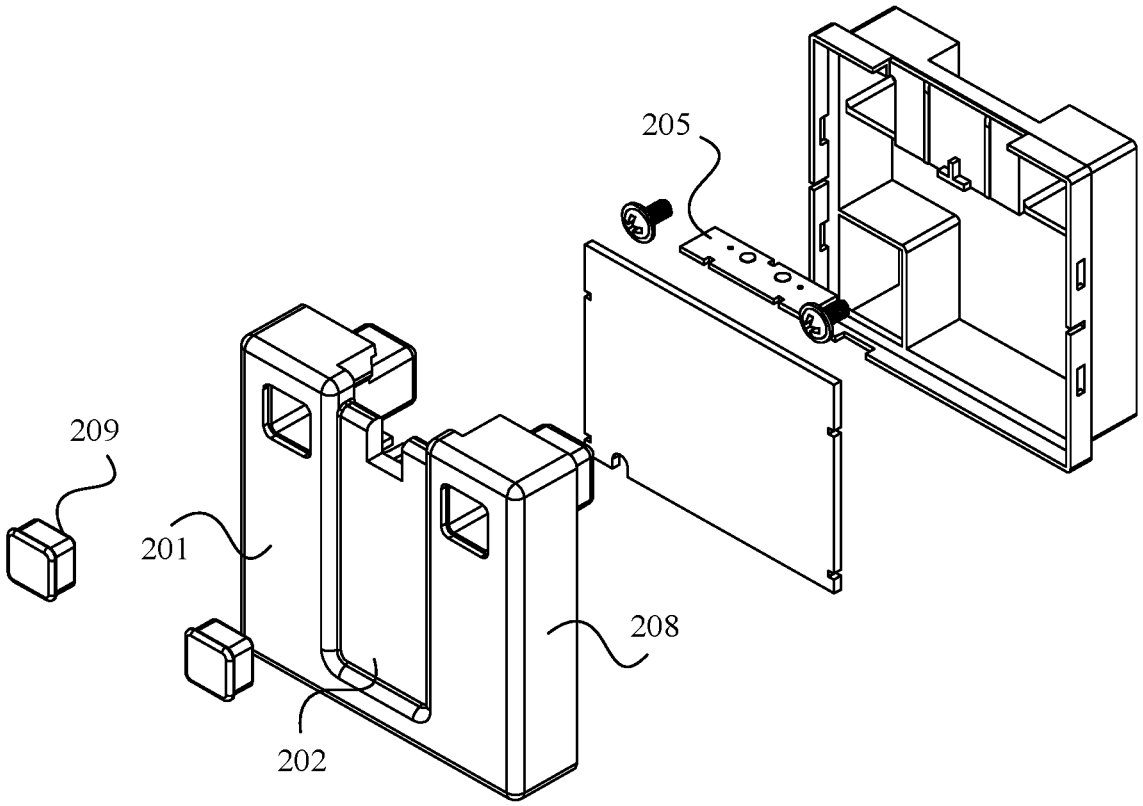
FIG. 4 is a schematic diagram of an exploded structure of a base provided in at least one example of the present disclosure.
Figure 5:
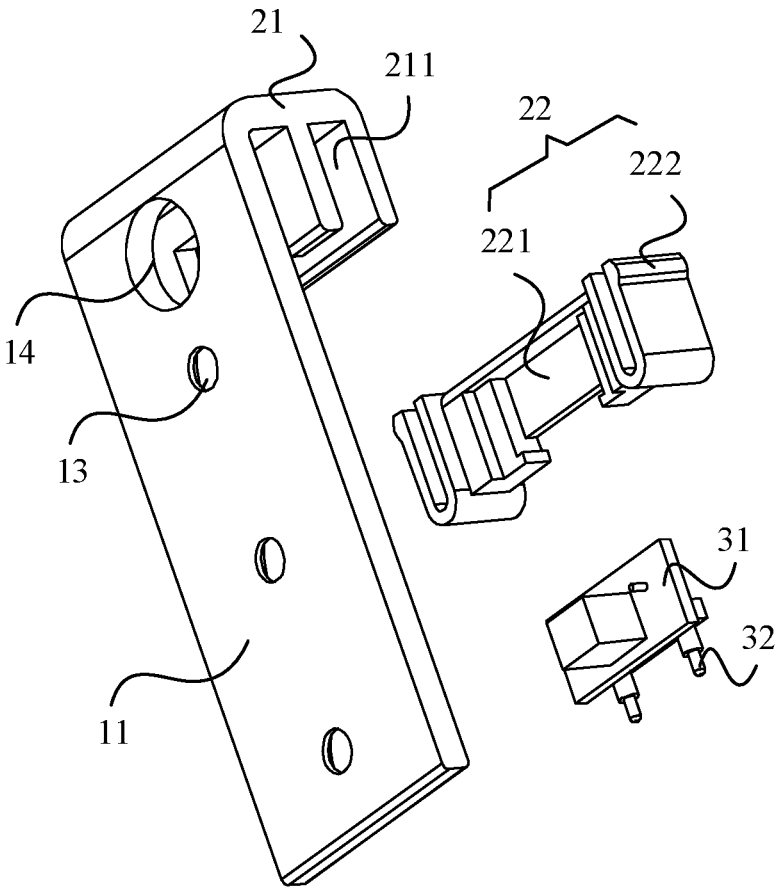
FIG. 5 is a schematic diagram of an exploded structure of a light source switching module provided in at least one example of the present disclosure.
Figure 6:
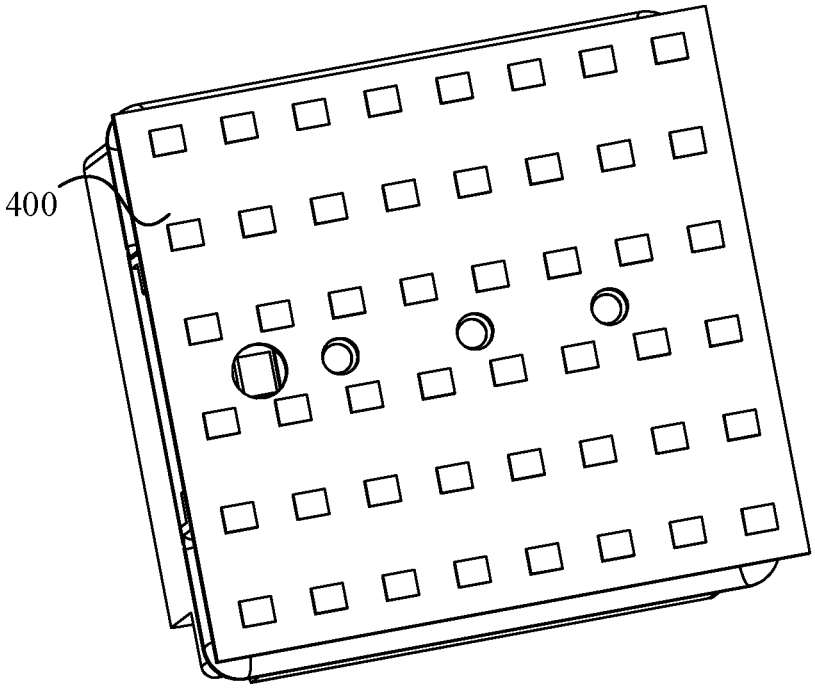
FIG. 6 is a schematic diagram of an installation structure of a light source module provided in at least one example of the present disclosure.
Figure 7:
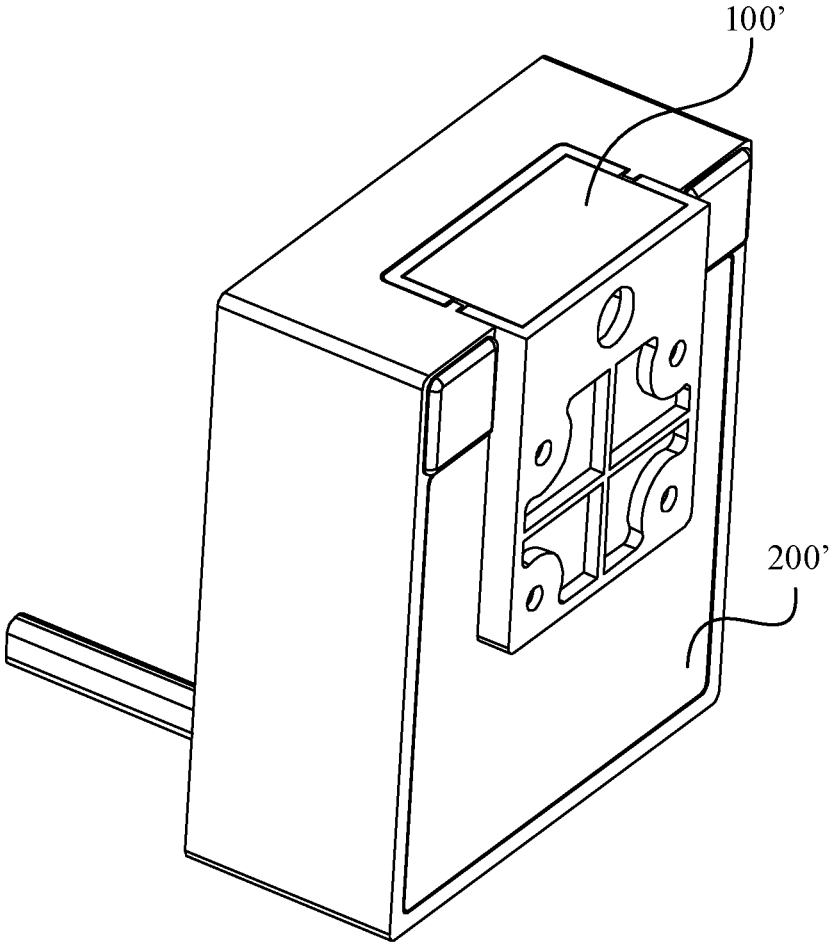
FIG. 7 is a schematic structural diagram of a light source switching module installed on a base provided in at least one example of the present disclosure.
Figure 8:
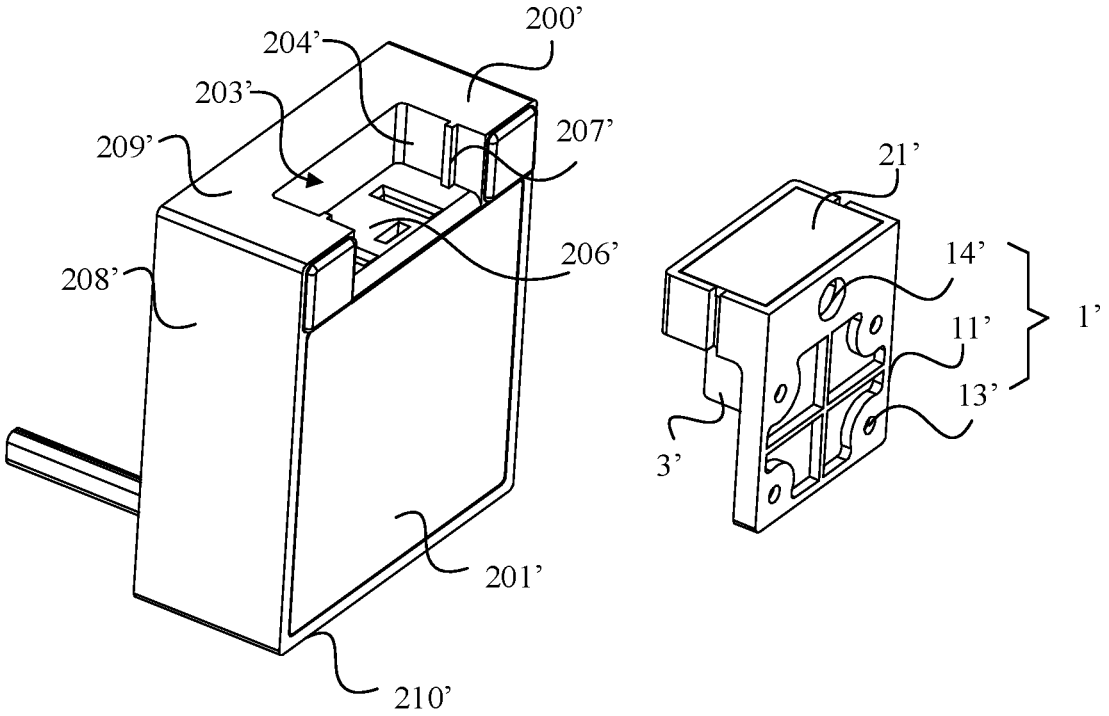
FIG. 8 is a schematic structural diagram of the light source switching module not installed on the base provided in at least one example of the present disclosure.
Figure 9:
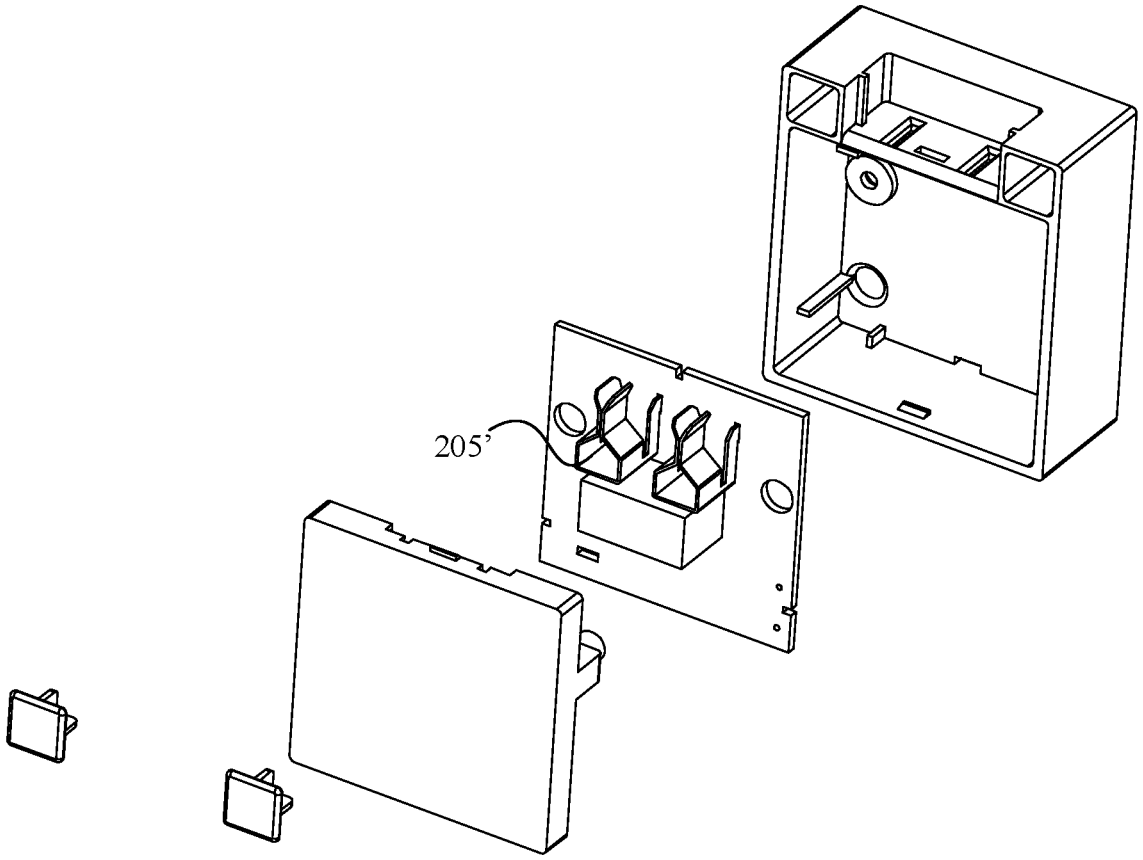
FIG. 9 is a schematic diagram of an exploded structure of a base provided in at least one example of the present disclosure.
Figure 10:
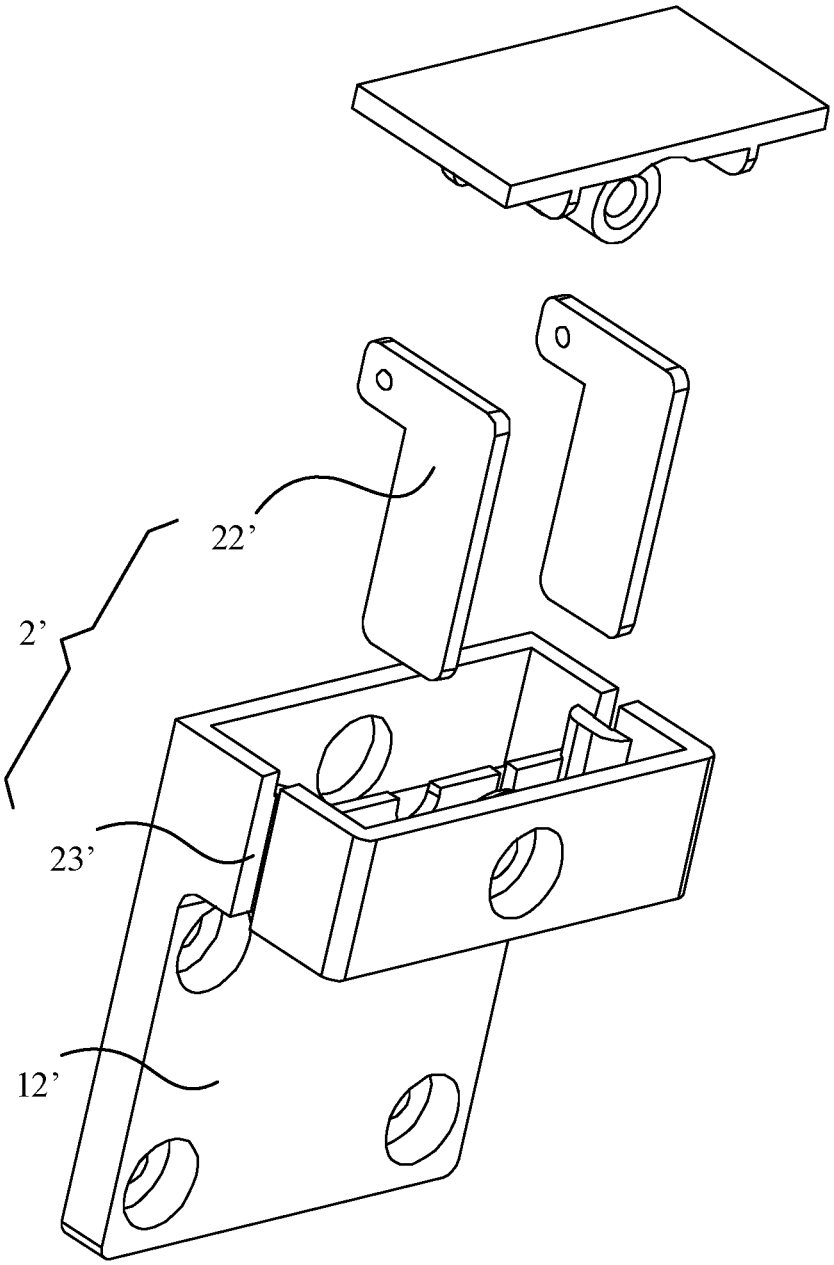
FIG. 10 is a schematic diagram of an exploded structure of a light source switching module provided in at least one example of the present disclosure.

As shown in FIG. 1, FIG. 2, and FIG. 6, in the present disclosure, a light source switching module 100 can be used for a lighting lamp such as a wall lamp, a ceiling lamp and a table lamp, and a light source module 400 of the lighting lamp is installed on a base 200 of the lighting lamp by the light source switching module 100. The light source switching module 100 includes a switching portion 1 provided with an installation portion 13 of the light source module 400, a mechanical connection portion 2 connected with the switching portion 1, and an electrical connection portion 3 conducting between the light source module 400 and a power supply connection terminal 205 of the base 200.

With the above arrangement, the light source module 400 is fixed on the light source switching module 100, and the light source switching module 100 is mechanically connected with the base 200 to realize detachable connection. In this way, when the light source module 400 is damaged and needs to be repaired or replaced, the light source switching module 100 is detached from the base 200, and then the light source module 400 is repaired and replaced. Therefore, when repairing or replacing the light source module 400, the base 200 does not to be detached, thereby saving labor and time; moreover, the light source switching module 100 can be produced in batch and series.

In order to achieve the above objective, the light source switching module 100 can be arranged in various ways. The configuration of the light source switching module 100 is described in detail hereinafter with examples.

In at least one example of the light source switching module 100, in order to facilitate the introduction of the light source switching module 100, the configuration of the base 200 and a lamp body 300 of a lighting lamp is described first, as shown in FIG. 1-FIG. 5.

The base 200, substantially rectangular in shape, includes a rear wall connected with a wall and a front wall 201 opposite to the rear wall which are spaced apart in a front-rear direction, a top wall 209 and a bottom wall 210 which are spaced apart in an up-down direction, and a pair of side walls 208 at both sides of the base 200. A socket 203 is formed by extending from the top wall 209 to the bottom wall 210. The socket 203 is of a conical structure with a small inside and a large outside, that is, socket walls 204 on both sides of the socket 203 are inclined surfaces to improve the fixation firmness of the light source switching module 100. An installation groove 202 is recessed from the front wall 201 toward the rear wall. The installation groove 202 is in communication with the outside and is U-shaped. The base 200 has a hollow structure and is provided internally with a driving power supply electrically connected with the mains. An inner side of the front wall 201 of the base 200 is fixed with a printed circuit board (PCB) connected with the driving power supply. The PCB is provided with a power supply connection terminal 205 facing the socket 203, and the power supply connection terminal 205 may specifically be a contact, a pogo pin or a gold finger.

The lamp body 300 is substantially rectangular in shape. An outer ring of the front wall 201 of the base 200 is provided with lugs, and the lamp body 300 is clamped on the base 200 and in contact with the outer ring of the front wall 201 of the base 200.

The switching portion 1 is substantially a rectangular plate, and a first surface 11 and a second surface 12 of the switching portion 1 are both planar. The installation portion 13 may be a screw hole, and the light source module is fixed on the switching portion 1 by screws, which has the advantages of simple structure and convenient assembly. A bending portion 21 is fixed on an end of the switching portion 1 and bent at 90 degrees relative to the switching portion 1. The bending portion 21 is provided with a clamping body 22, thereby forming the mechanical connection portion 2.

The bending portion 21 and the switching portion 1 may be integral in structure, and are composed of the same plate and convenient to manufacture. The bending portion 21 is provided with a clamping groove. When the light source switching module 100 has been installed, the bending portion 21 covers the socket 203 of the base 200, and forms an external surface of the base 200 together with the top wall 209 of the base 200. In this way, after the lamp body 300 is installed, the lamp body 300 is crimped with the switching portion 1 to fix the light source switching module 100 to a certain extent, thereby improving the fixation firmness of the light source switching module 100.

The clamping body 22 includes a clamping plate 221 and two elastic clamping portions 222. The clamping plate 221 and the elastic clamping portions 222 can be formed integrally, i.e., both ends of a plate are bent into a U-shaped structure, so that both ends of the plate have a certain elastic deformation capacity, forming the clamping plate 221 and the elastic clamping portions 222. One side of the clamping plate 221 is provided with a lug which is clamped in the clamping groove 211 of the bending portion 21, so that the clamping plate 221 is perpendicular to the switching portion 1 and fixed in the clamping groove 211 of the bending portion 21, and the elastic clamping portion 222 is exposed from the bending portion 21. After the light source switching module 100 is installed, the elastic clamping portion 222 is clamped to the socket walls 204, and the light source switching module 100 is fixed by the socket walls 204.

The electrical connection portion 3 includes a circuit board 31 and conductive terminals 32 connected with the circuit board 31 and located on one surface of the circuit board 31. The conductive terminals 32 face away from the bending portion 21 and face the power supply connection terminal 205. The conductive terminals 32 may be contacts or pogo pins. The conductive terminals 32 are preferred as pogo pins herein, and the power supply connection terminal 205 of the base 200 is a contact. The pogo pins are parallel to the switching portion 1.

When installing the light source switching module 100, the switching portion 1 is placed in the installation groove 202, and is movable along the extension direction (i.e., the up-down direction) of the installation groove 202. At the same time, the clamping body 22 and the conductive terminals 32 are driven by the switching portion 1 to move close to the socket 203 in the direction parallel to the front wall 201 of the base 200 until the clamping plate is clamped in the two socket walls 204 of the socket 203, and the conductive terminals 32 are abutted against the power supply connection terminal 205 of the base 200. Such arrangement is simple in structure and convenient for assembling, thereby saving labor and time. The light source switching module 100 is fixed on the base 200 in the direction parallel to the front wall 201 of the base 200, so that the fixation firmness of the lamp body 300 can be improved.

In at least one example of a light source switching module 100', as shown in FIG. 7-FIG. 10, a base 200', substantially rectangular in shape, includes a rear wall connected with a wall and a front wall 201' opposite to the rear wall which are spaced apart in the front-rear direction, a top wall 209' and a bottom wall 210' which are spaced apart in the up-down direction, and a pair of side walls 208' at both sides of the base 200'.

A socket 203' is formed by extending from the top wall 209' to the bottom wall 210'. The socket walls 204' on both sides of the socket 203' are substantially parallel, and a second guide portion 207' is arranged on an inner surface of the socket walls 204'. The second guide portion 207' may be specifically a guide projection extending along a moving direction of the light source switching module 100'. A connection terminal receiving portion 206' is arranged close to the inner of the base 200' and is connected with inner ends of the socket walls 204'. The connection terminal receiving portion 206' is provided with two spaced spring tab holes. The base 200' has a hollow structure and is disposed internally with a driving power supply electrically connected with the mains. The power supply connection terminal 205' is an on-board socket located in the connection terminal receiving portion 206', and the on-board socket includes two metal sheets.

A switching portion 1' is substantially a rectangular plate, and a first surface 11' and a second surface 12' of the switching portion 1' are both planar. The installation portions 13' may be screw holes, and the light source module is fixed on the switching portion 1' by screws, which has the advantages of simple structure and convenient assembly. A bending portion 21' is fixed on an end of the switching portion 1' and bent at 90 degrees relative to the switching portion 1'. First guide portions 23' are provided on both sides of the bending portion 21', and the first guide portions 23' are specifically guide grooves extending along the moving direction of the light source switching module 100'. Two inserting pieces are fixed at intervals on the bending portion 21', and a clamping bodies 22' and meanwhile an electrical connection portion 3' are formed by spring tabs.

When installing the light source switching module 100', the switching portion 1' is placed on the first surface 11', the first guide portion 23' is aligned with the second guide portion 207', and the switching portion 1' is moved along the first guide portion 23'. At the same time, the spring tabs are driven by the switching portion 1' to move close to the socket 203' along the direction parallel to the front wall 201' of the base 200' until the spring tabs enter the inner of the base 200' through the spring tab holes, and are clamped between the two metal sheets. Such arrangement has the advantages of simple structure, low cost, and convenient assembly, thereby saving labor and time.

In other examples, the bending portion may be fixed in the middle of the switching portion, and the light source switching module may be clamped on the base perpendicular to the front wall of the base, etc.

A light source assembly of the present disclosure includes a base 200, a driving power supply fixed in the base, a power supply connection terminal 205 fixed in the base 200 and connected with the driving power supply, and a light source switching module 100 fixed on the base 200, in which the light source switching module 100 is the light source switching module mentioned above, the switching portion 1 is located on the base 200, the mechanical connection portion 2 is mechanically connected with the base 200, and the electrical connection portion 3 is electrically connected with the power supply connection terminal 205. In the light source assembly, the light source switching module 100 is mechanically connected with the base 200, so as to realize detachable connection. When the light source module 400 is damaged and needs to be repaired or replaced, the light source switching module 100 is detached from the base 200, and then the light source module 400 is repaired or replaced. In this way, when the light source module 400 is repaired or replaced, the base 200 does not to be detached, thereby saving labor and time.

A lighting lamp of the present disclosure includes a base 200, a light source switching module 100 connected with the base 200, a light source module 400 arranged on the light source switching module 100, and a lamp body 300 connected with the base 200, in which the light source switching module 100 is the light source switching module 100 mentioned above. In the lighting lamp, the light source switching module 100 is mechanically connected with the base 200, so as to realize detachable connection. When the light source module 400 is damaged and needs to be repaired or replaced, the light source switching module 100 is detached from the base 200, and then the light source module 400 is repaired or replaced. In this way, when the light source module 400 is repaired or replaced, the base 200 does not to be detached, thereby saving labor and time.

The base 200, substantially rectangular in shape, includes a bottom surface that can be connected with a wall, a front wall 201 opposite to the bottom surface, and side walls 208 located at both sides of the base 200. One side wall 208 is provided with an opening to form a socket 203. The front wall 201 is provided with an installation groove 202 extending to the socket 203, the switching portion 1 is in the installation groove 202, and the first surface 11 of the switching portion 1 is flush with the front wall 201 of the base 200, so that the base 200 can support the light source module 400. The base 200 has a hollow structure and is provided internally with a driving power supply. An inner side of the front wall 201 of the base 200 is fixed with a printed circuit board (PCB) connected with the power supply, and the PCB is provided with a connection terminal 205 facing the socket 203, so as to facilitate the contact between the conductive body of the light source switching module 100 and the connection terminal 205.

The shell of the base 200 may be formed by threaded connection of two parts. A decorative cover 208 is arranged on threaded holes to cover the threaded holes.

The lamp body 300 is substantially rectangular in shape. An outer ring of the front wall 201 of the base 200 is provided with lugs, and the lamp body 300 is clamped on the base 200 and in contact with the outer ring of the front wall 201 of the base 200. After the light source switching module 100 are installed, the lamp body 300 is crimped with the switching portion 1 to fix the light source switching module 100 to a certain extent, thereby improving the fixation firmness of the light source switching module 100.

The examples of the present disclosure provide a light source switching module.

A light source switching module of the present disclosure is applicable for installing a light source module on a base, the light source switching module comprises: a switching portion provided with an installation portion for installing the light source module; a mechanical connection portion fixed on the switching portion and mechanically connected with the base; and an electrical connection portion electrically connected with a power supply connection terminal in the base and electrically connected with the light source module.

Optionally, the mechanical connection portion comprises a bending portion arranged at an end of the switching portion and bent relative to the switching portion, and a clamping body arranged on the bending portion, and the clamping body is inserted and clamped into the base along a direction parallel to a top wall of the base.

Optionally, the bending portion and side walls of the base are configured to form an external surface of the base.

Optionally, the clamping body comprises a clamping plate connected with the bending portion and elastic clamping portions at both ends of the clamping plate, and the elastic clamping portions protrude through the bending portion and are elastically clamped in the base.

Optionally, the electrical connection portion comprises conductive terminals fixed on the bending portion, and the conductive terminals face away from the bending portion and connected with the light source module through a flat cable.

Optionally, the switching portion comprises a switching plate, the switching plate comprises a first surface, a second surface opposite to the first surface, and a through hole penetrating the first surface and the second surface, the first surface is provided with the installation portion, the second surface abuts against the top wall of the base, and the flat cable passes through the through hole.

Optionally, the mechanical connection portion is an inserting piece connected with the bending portion, and the inserting piece is clamped to the power supply connection terminal and configured as the electrical connection portion.

Optionally, first guide portions are arranged on both sides of the bending portion, and the first guide portions are matched with second guide portions of a socket of the base.

A light source assembly of the present disclosure comprises a base, a driving power supply fixed in the base, a power supply connection terminal fixed in the base and connected with the driving power supply, and a light source switching module fixed on the base. The light source switching module is the light source switching module according to any one of the examples of the present disclosure, the switching portion is located on the base, the mechanical connection portion is mechanically connected with the base, and the electrical connection portion is electrically connected with the power supply connection terminal.

A lighting lamp of the present disclosure comprises a base provided with a power supply connection terminal, a light source switching module connected with the base, a light source module arranged on the light source switching module, and a lamp body connected with the base. The light source switching module is the light source switching module according to the examples of the present disclosure.

Optionally, the base comprises a rear wall that is capable of being connected with a wall, a front wall opposite to the rear wall, and a top wall connected with the front wall and the rear wall, the top wall is provided with a socket, the mechanical connection portion is inserted into and fixed on the base by the socket, and the power supply connection terminal faces the socket.

Optionally, the front wall is provided with an installation groove, and the switching portion is in the installation groove.

Optionally, the lamp body is crimped with the switching portion.

At least one technical solution adopted in the examples of the present disclosure can achieve the following beneficial effects:

a light source module is fixed on the light source switching module, and the light source switching module is mechanically connected with a base to realize detachable connection. In this way, when the light source module is damaged and needs to be repaired or replaced, the light source switching module is detached from the base, and then the light source module is repaired or replaced. Therefore, when the light source module is maintained or replaced, the base does not need to be detached, thereby saving labor and time.

The present disclosure may include dedicated hardware implementations such as application specific integrated circuits, programmable logic arrays and other hardware devices. The hardware implementations can be constructed to implement one or more of the methods described herein. Examples that may include the apparatus and systems of various implementations can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The above descriptions are only examples of the present disclosure and are not intended to limit the present disclosure. For those skilled in the art, the present disclosure can have various modifications and changes. Any modification, equivalent replacement, improvement, and the like made within the spirit and principle of the present disclosure shall be included in the scope of the present disclosure.

What is claimed is:

1. A light source switching module, applicable for installing a light source module on a base, wherein the light source switching module comprises:

a switching portion provided with an installation portion for installing the light source module;

a mechanical connection portion fixed on the switching portion and mechanically connected with the base; and an electrical connection portion electrically connected with a power supply connection terminal in the base and electrically connected with the light source module, wherein the mechanical connection portion comprises:

a bending portion arranged at an end of the switching portion and bent relative to the switching portion, and a clamping body arranged on the bending portion, and the clamping body is inserted and clamped into the base.

2. The light source switching module according to claim 1, wherein the clamping body is inserted and clamped into the base along a direction parallel to a top wall of the base.

3. The light source switching module according to claim 2, wherein the bending portion and side walls of the base are configured to form an external surface of the base.

4. The light source switching module according to claim 2, wherein the clamping body comprises:

a clamping plate connected with the bending portion, and elastic clamping portions at both ends of the clamping plate, and the elastic clamping portions protrude through the bending portion and are elastically clamped in the base.

5. The light source switching module according to claim 2, wherein the electrical connection portion comprises conductive terminals fixed on the bending portion, and the conductive terminals face away from the bending portion and connected with the light source module through a flat cable.

6. The light source switching module according to claim 5, wherein the switching portion comprises a switching plate, and the switching plate comprises:

a first surface, a second surface opposite to the first surface, and a through hole penetrating the first surface and the second surface, wherein the first surface is provided with the installation portion, the second surface abuts against the top wall of the base, and the flat cable passes through the through hole.

7. The light source switching module according to claim 2, wherein the mechanical connection portion is an inserting piece connected with the bending portion, and the inserting piece is clamped to the power supply connection terminal and configured as the electrical connection portion.

8. The light source switching module according to claim 7, wherein first guide portions are arranged on both sides of the bending portion, and the first guide portions are matched with second guide portions of a socket of the base.

9. A light source assembly, comprising:

a base, a driving power supply fixed in the base, a power supply connection terminal fixed in the base and connected with the driving power supply, and a light source switching module fixed on the base, wherein the light source switching module comprises: a switching portion provided with an installation portion for installing the light source module; a mechanical connection portion fixed on the switching portion and mechanically connected with the base; and an electrical connection portion electrically connected with a power supply connection terminal in the base and electrically connected with the light source module; and the switching portion is located on the base, the mechanical connection portion is mechanically connected with the base, and the electrical connection portion is electrically connected with the power supply connection terminal, wherein the mechanical connection portion comprises:

a bending portion arranged at an end of the switching portion and bent relative to the switching portion, and a clamping body arranged on the bending portion, and the clamping body is inserted and clamped into the base.

10. The light source assembly according to claim 9, wherein the clamping body is inserted and clamped into the base along a direction parallel to a top wall of the base.

11. The light source assembly according to claim 10, wherein the clamping body comprises:

a clamping plate connected with the bending portion, and elastic clamping portions at both ends of the clamping plate, and the elastic clamping portions protrude through the bending portion and are elastically clamped in the base.

12. A lighting lamp, comprising:

a base provided with a power supply connection terminal, a light source switching module connected with the base, a light source module arranged on the light source switching module, and a lamp body connected with the base, wherein the light source switching module comprises a switching portion provided with an installation portion for installing the light source module; a mechanical connection portion fixed on the switching portion and mechanically connected with the base; and an electrical connection portion electrically connected with a power supply connection terminal in the base and electrically connected with the light source module, wherein the mechanical connection portion comprises:

a bending portion arranged at an end of the switching portion and bent relative to the switching portion, and a clamping body arranged on the bending portion, and the clamping body is inserted and clamped into the base.

13. The lighting lamp according to claim 12, wherein the base comprises:

a rear wall that is capable of being connected with a wall, a front wall opposite to the rear wall, and a top wall connected with the front wall and the rear wall, wherein the top wall is provided with a socket, the mechanical connection portion is inserted into and fixed on the base by the socket, and the power supply connection terminal faces the socket.

14. The lighting lamp according to claim 12, wherein the front wall is provided with an installation groove, and the switching portion is in the installation groove.

15. The lighting lamp according to claim 12, wherein the lamp body is crimped with the switching portion.

16. The lighting lamp according to claim 12, wherein the clamping body is inserted and clamped into the base along a direction parallel to a top wall of the base.

17. The lighting lamp according to claim 16, wherein the electrical connection portion comprises conductive terminals fixed on the bending portion, and the conductive terminals face away from the bending portion and connected with the light source module through a flat cable.

18. The lighting lamp according to claim 17, wherein the switching portion comprises a switching plate, and the switching plate comprises:

a first surface, a second surface opposite to the first surface, and a through hole penetrating the first surface and the second surface, wherein the first surface is provided with the installation portion, the second surface abuts against the top wall of the base, and the flat cable passes through the through hole.

19. The lighting lamp according to claim 16, wherein the mechanical connection portion is an inserting piece connected with the bending portion, and the inserting piece is clamped to the power supply connection terminal and configured as the electrical connection portion.

20. The lighting lamp according to claim 19, wherein first guide portions are arranged on both sides of the bending portion, and the first guide portions are matched with second guide portions of a socket of the base.

* * * * *